US005940906A

United States Patent [19]

Halloran

[11] Patent Number: 5,940,906

[45] Date of Patent: Aug. 24, 1999

[54] APRON ASSEMBLY FOR A BATHING FIXTURE

[75] Inventor: Daniel N. Halloran, Saukville, Wis.

[73] Assignee: Kohler Co., Kohler, Wis.

[21] Appl. No.: 09/008,011

[22] Filed: Jan. 16, 1998

[51] Int. Cl.[6] ..... A47K 3/02

[52] U.S. Cl. ..... 4/584

[58] Field of Search ..... 4/538, 584

[56] References Cited

U.S. PATENT DOCUMENTS

| | | | |
|---|---|---|---|
| 1,009,483 | 1/1911 | Danver | 4/584 |
| 2,269,748 | 1/1942 | Widman | 4/173 |
| 2,695,256 | 11/1954 | DeOlloqui et al. | 154/83 |
| 2,784,417 | 3/1957 | Strand | 4/173 |
| 2,967,309 | 1/1961 | Corp | 4/173 |
| 3,028,603 | 4/1962 | Rodman | 4/173 |
| 3,412,727 | 11/1968 | Hurko | 126/211 |
| 4,290,154 | 9/1981 | Benjamin | 4/538 |
| 4,541,130 | 9/1985 | Calvert et al. | 4/593 |
| 4,669,133 | 6/1987 | Blecher et al. | 4/538 |
| 5,864,898 | 2/1999 | Knap et al. | 4/584 |

FOREIGN PATENT DOCUMENTS

| | | | |
|---|---|---|---|
| 85 18 953 | 8/1985 | Germany . | |
| 3839614 | 5/1990 | Germany | 4/584 |
| 94 04 056 | 5/1994 | Germany . | |
| 0507425 | 6/1939 | United Kingdom | 4/584 |
| 0844323 | 8/1960 | United Kingdom | 4/584 |
| 1028079 | 5/1966 | United Kingdom | 4/584 |

*Primary Examiner*—Charles E. Phillips
*Attorney, Agent, or Firm*—Quarles & Brady LLP

[57] ABSTRACT

An apron assembly for a bathing fixture which has a frame allowing access to equipment placed behind it, yet affords a stable construction. A substantially rigid apron assembly is afforded by a special brace element, even though the frame is manufactured from a reduced amount of material. The essentially "I"- shaped brace reinforces the apron and receives an attachment bolt.

5 Claims, 3 Drawing Sheets

FIG. 1
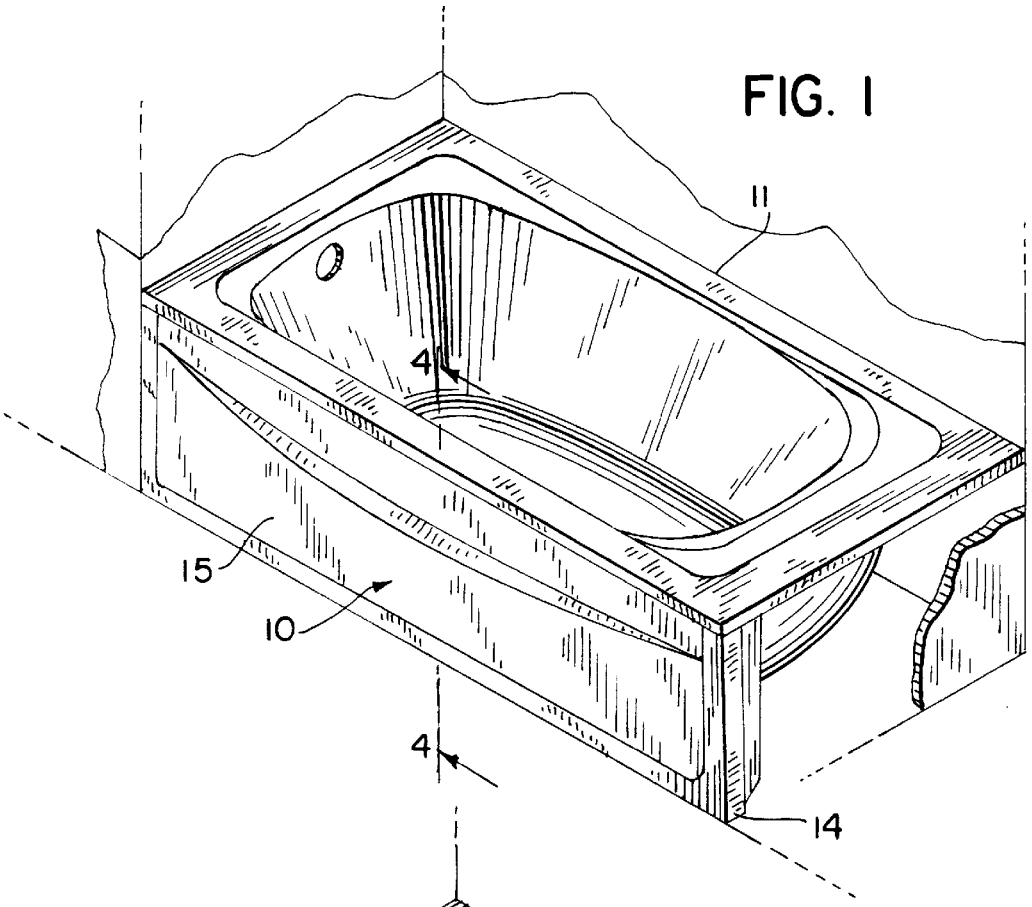
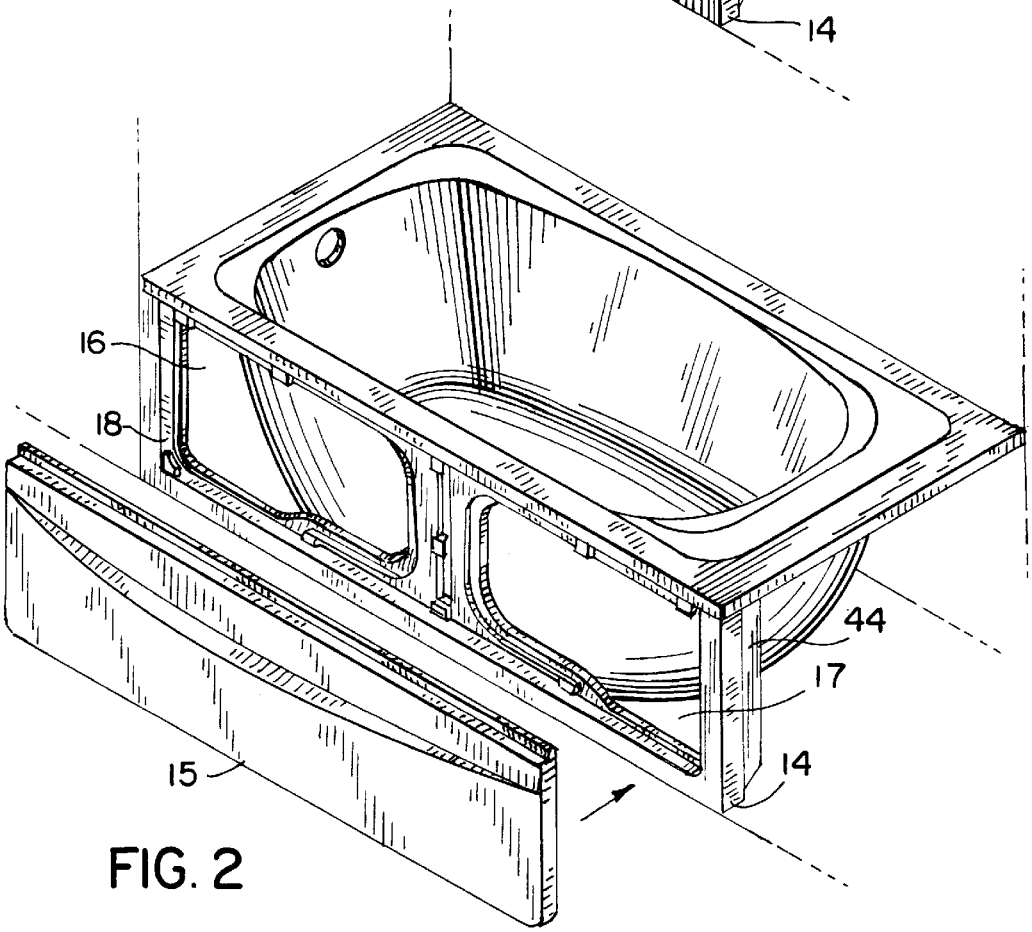
FIG. 2

APRON ASSEMBLY FOR A BATHING FIXTURE

CROSS-REFERENCE TO RELATED APPLICATIONS (Not applicable)

STATEMENT REGARDING FEDERALLY SPONSORED RESEARCH (Not Applicable)

BACKGROUND OF THE INVENTION

This invention relates to structures for enclosing bathing fixtures such as bathtubs and whirlpools. More particularly, it relates to aprons for attachment thereto.

Aprons for bathtubs and whirlpools are commonly used to give a finished look to a bathtub and whirlpool, and in the instance of the latter, to provide access (when needed) to equipment such as pumps, motors, piping, etc. located behind the apron. A problem arises with installing aprons which are made of lightweight materials and securing them to the bathing fixture. For example, there is currently available an adjustable frame for an apron which has access openings to various equipment with a central divider support. This presents a problem from a stability standpoint.

In U.S. Pat. No. 2,269,748 there is described a vertical pillar element 32 which extends between the doors 29 to frame the opening therefor. In U.S. Pat. No. 4,290,154 structural members 48 are attached to plate 46 of apron panel 44 to provide structural strength.

A much improved apron is described in U.S. Ser. No. 08/700,715, filed on Aug. 13, 1996, U.S. Pat. No. 5,864,898. However, even that structure has deficiencies with respect to requiring use of relatively expensive bearing braces.

Thus, it can be seen that a need exists for an improved low cost apron assembly.

BRIEF SUMMARY OF THE INVENTION

In one aspect, the invention provides an apron assembly for a bathing fixture which includes a tub having an outwardly extending rim. A frame member is provided having at least two opposing open sections with a central supporting portion therebetween. It is constructed and arranged to be positioned in front of a side wall of the tub. The frame member contacts the rim adjacent an upper portion of the frame member.

A brace member is connected to the central supporting portion. An adjustment bolt is threadably and extendably connected to the frame member and brace member adjacent an upper end portion the brace for engagement with the side wall of the tub. A panel structure is adapted to be positioned on the frame member to cover the open sections.

In a preferred embodiment, the brace member is hourglass shaped or "I"-shaped, and includes two bar members positioned at a bottom of the brace member for contact with the supporting portion of the frame member. The brace member can be fastened to the supporting portion by an adhesive.

In another preferred embodiment, the adjustment bolt is threadably and extendably connected to the frame member by an opening extending through the frame member with nut members engaging the adjustment bolt and positioned on opposing sides of the opening.

The objects of the invention therefore include:

a. providing an apron assembly of the above kind which can provide ready access to equipment placed behind the apron assembly yet afford a solid, lightweight construction;

b. providing an apron assembly of the above kind having a frame which can be manufactured from readily available materials at low cost;

c. providing an apron assembly of the above kind which can be easily installed; and d. providing an apron assembly of the above kind which can be fitted to bathing fixtures having rims of various dimensions and independent of bathtubs having no additional attachment hardware.

These and still other objects and advantages of the invention will be apparent from the description which follows. In the detailed description below, a preferred embodiment of the invention will be described in reference to the accompanying drawings. The embodiment does not represent the full scope of the invention. Rather the invention may be employed in other embodiments. Reference should therefore be made to the claims herein for interpreting the breadth of the invention.

BRIEF DESCRIPTION OF THE DRAWINGS

FIG. 1 is a top perspective view (partially fragmented) illustrating an apron assembly of this invention;

FIG. 2 is a view similar to FIG. 1, albeit with an apron front cover panel removed;

DESCRIPTION OF THE PREFERRED EMBODIMENT

Figure 3:
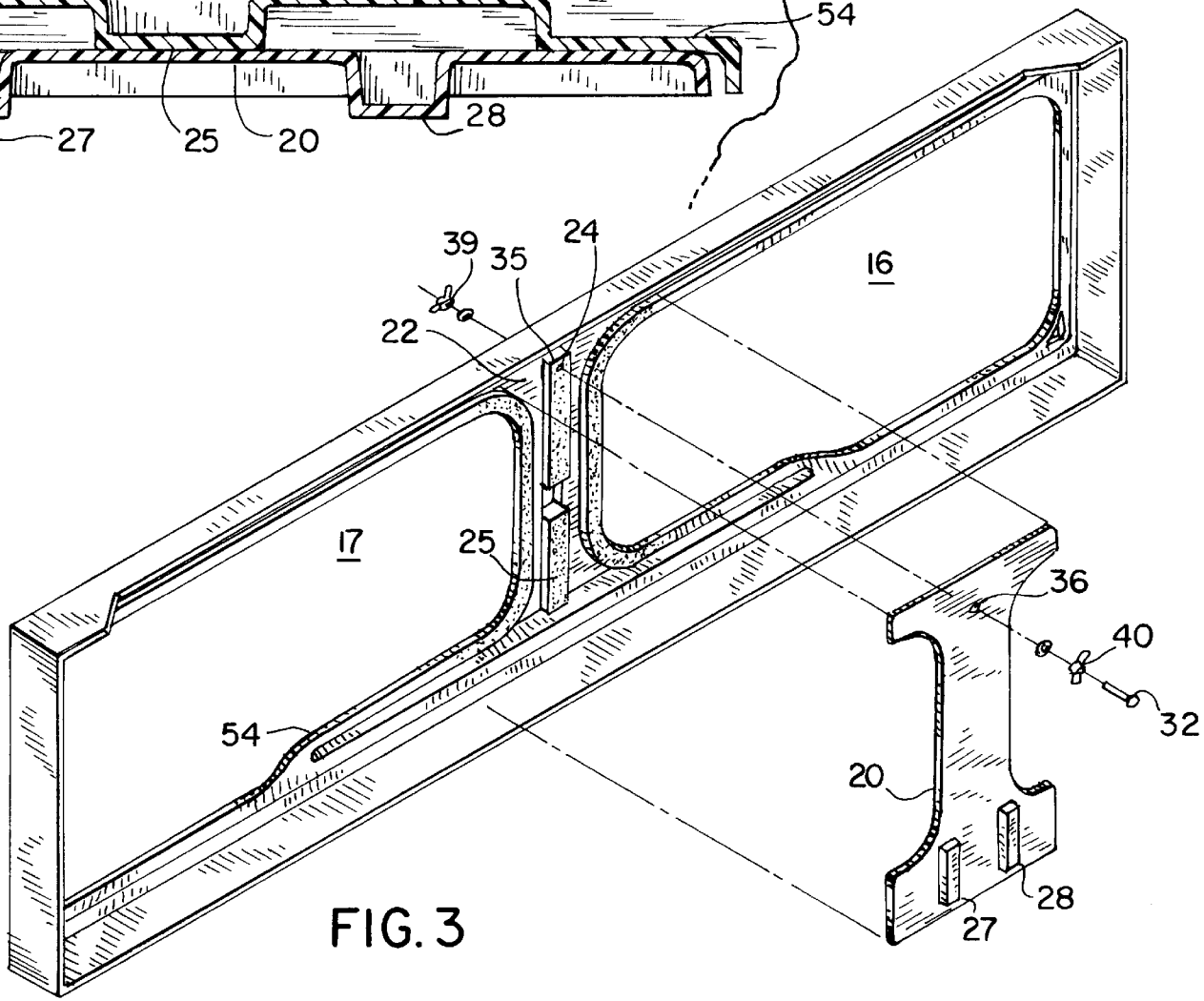
FIG. 3 is an enlarged exploded view of a frame of the present invention and brace components for use therewith.

Referring first to FIGS. 1 and 2, the apron assembly, generally 10, is shown attached to bathtub 11. The apron assembly includes a frame member 14 with open sections 16 and 17 positioned in a recessed section 18. A cover panel member 15 is dimensioned to fit into the recessed section 18 and over the open sections 16 and 17. The frame member 14 and panel member 15 are preferably composed of a plastic material.

Referring specifically now to FIG. 3, there is a rear brace member 20 composed of metal or rigid plastic for attachment to a center section 22 of frame member 14 by means of gluing, other adhesive other means. Frame member 14 has support portions 24 and 25 in the center section 22 for contact with the brace member 20. This is also seen in FIG. 4.

Brace member 20 is preferably of an "I"-shape or hourglass shaped configuration with the stabilizing reinforcing bars 27, 28 at its bottom.

Figure 4:
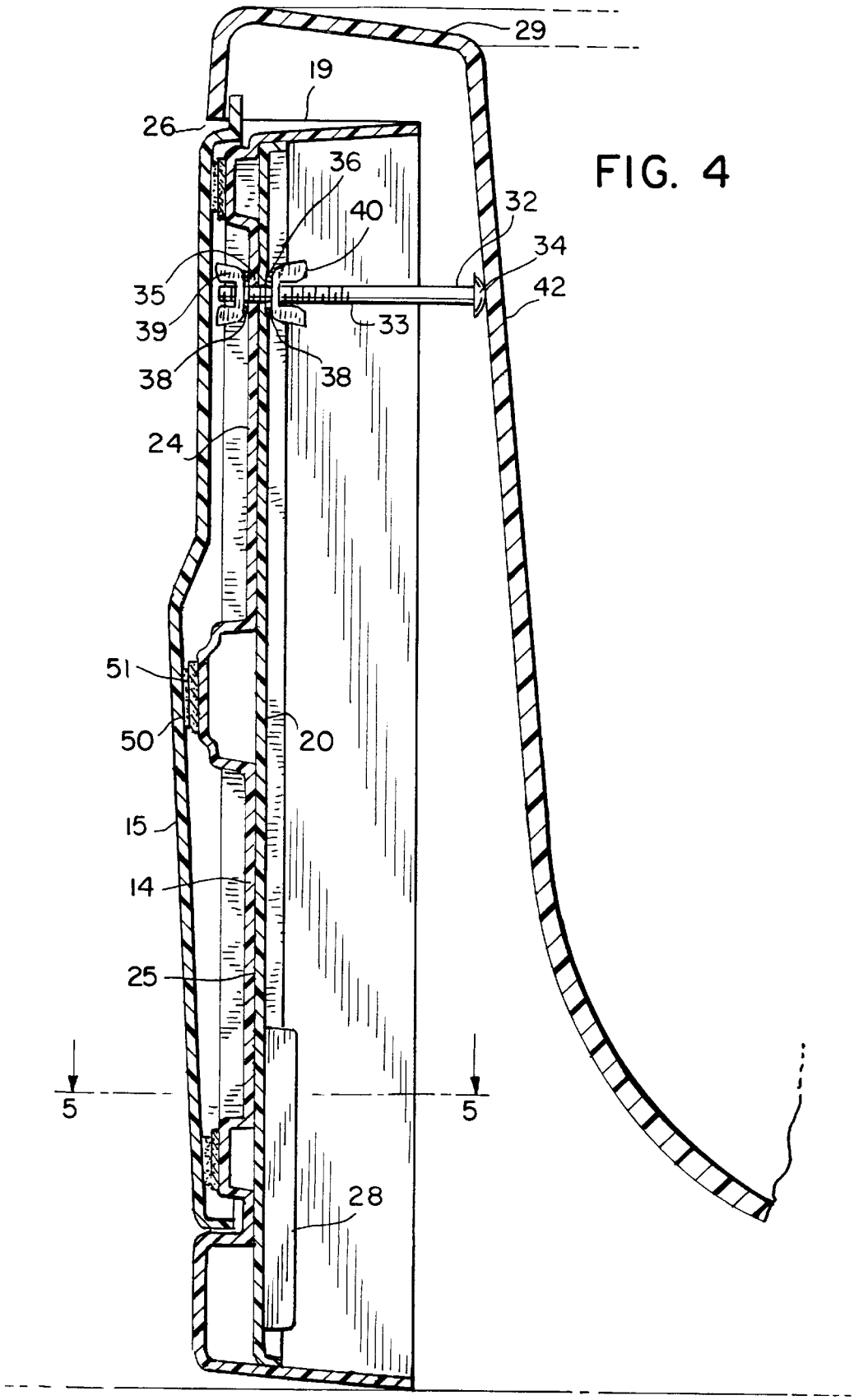
FIG. 4 is a view in section taken along line 4—4 of FIG. 1.

As best seen in FIGS. 3 and 4, a bolt 32 with threads 33 is passed through opening 36 in brace member 20 and opening 35 in frame support portion 24. It is secured therein by the washers 38 and wing nuts 39 and 40. To secure the apron assembly to the bathing fixture 11, the frame member 14 has its top portion 19 positioned under the rim 29 of the bathing fixture 11. The frame member 14 is pushed up until the top portion 19 engages the lower surface 26 of rim 29. At this stage, a bolt 32 is selected which can best be adjusted to span the distance from the frame member 14 to the front outside of the bath (as represented by the side wall 42).

The bolt is threaded into the wing nuts 39, 40 and opening 36 in the brace 20 as far as it can go. The frame member 14 is then squared to the rim 29, and the side braces such as shown at 44 (See FIG. 2) of the frame are secured to studs such as with the screws passing through the side braces. The bottom of the frame member 14 is also secured to a subfloor with screws. If necessary, some shimming can be effected for the frame member 14 at the bottom thereof.

The next step is the unthreading or outthreading of the carriage bolt 32 until its head 34 makes contact with the side wall 42. Then the bolt is locked in position by tightening the wing nuts 39 and 40. The apron panel member 15 is then centered on the frame member 14 and pressed onto it. The lip 46 of the panel member 15 is sandwiched behind rim 29. The panel member 15 will also be engaged by the hook and loop fasteners 50 and 51 (e.g. Velcro® brand) which are preferably adhesively secured to the respective and frame member 14 and panel member 15.

When it is necessary to remove the panel member 15 from the frame member 14, such as to have access to the usual equipment and plumbing placed behind the apron, all that is necessary is to place, for example, the head of a screwdriver between the panel member 15 and the frame member 14 at the bottom of the panel and pry it from this position.

Figure 5:
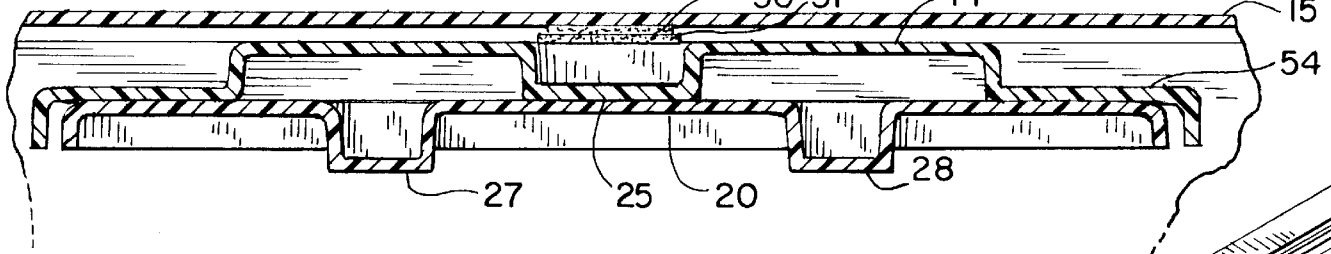
FIG. 5 is a view in section taken along line 5—5 of FIG. 4.

An important feature of the apron assembly of this invention is the rigidity of the frame member 14 provided by the brace member 20 secured to the center section 22 of the frame member 14, notwithstanding its very light weight. This affords superior midspan rigidity and overall deflection capabilities of the frame member 14, as well as the panel member 15. The bars 27 and 28 at the bottom of the brace member 20 span across the bottom horizontal section 54 of the frame member 14 to add further reinforcement. This is seen in FIGS. 3 and 5.

Another feature is the placement of the bolt 32 on the brace member 20 adjacent the open sections 16 and 17. This allows for access to the adjustment bolt 32 during the alignment process, as well as access to equipment normally housed behind the apron.

Still another feature of the invention is the positioning of the lip 23 behind the rim 29. This provides a stable placement.

Yet another feature is the ease of placement and removal of the panel member 38 by means of the hook and loop fasteners 50 and 51.

Thus, the invention provides an improved apron assembly. While a preferred embodiment has been described above, it should be readily apparent to those skilled in the art that a number of modifications and changes may be made without departing from the spirit and scope of the invention. For example, while hook and loop fasteners 50 and 51 are illustrated for holding the panel 15 and frame 14 members together, screws could be substituted. Additionally, wing nuts 39 and 40 are the preferred fasteners for the bolt 32. The more common multisided nuts could be substituted. Also, the specific materials mentioned are not the only materials which can be used. All such and other modifications within the scope of the invention are meant to be in the scope of the invention.

We claim:

1. An apron assembly for a bathing fixture, comprising:

a tub having an outwardly extending rim;

a frame member having at least two opposing open sections with a central supporting portion therebetween, said frame member constructed and arranged to be positioned in front of a side wall of the tub, the frame member contacting the rim adjacent an upper portion of the frame member;

a brace member having and upper end and a lower end and a vertically extending portion extending therebetween along said central supporting portion and being connected to said supporting portion;

an adjustment bolt having a portion thereof threadably and extendably connected to the frame member and brace member adjacent said upper end portion of the brace member such that one end of said bolt can engage; the side wall of the tub upon adjustment of said bolt in a direction of said tub; and a panel structure adapted to be positioned onto the frame member to cover the open sections.

2. The apron assembly for a bathing fixture as defined in claim 1, wherein said brace member further includes two bar members positioned adjacent a bottom portion of the brace member for contact with said supporting portion of the frame member.

3. The apron assembly for a bathing fixture as defined in claim 1, wherein said brace member is fastened to said supporting portion by an adhesive.

4. The apron assembly of claim 1, wherein the brace is essentially "I"-shaped.

5. The apron assembly for a bathing fixture as defined in claim 1, wherein said adjustment bolt is threadably and extendably connected to said frame member by an opening extending through said frame member and nut members engaging said adjustment bolt and positioned on opposing sides of said opening.

* * * * *